US006799449B2

(12) United States Patent
Park

(10) Patent No.: US 6,799,449 B2
(45) Date of Patent: Oct. 5, 2004

(54) APPARATUS FOR SUPERPLASTIC FORMING

(75) Inventor: Jong-Woo Park, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 10/392,595

(22) Filed: Mar. 20, 2003

(65) Prior Publication Data

US 2003/0177801 A1 Sep. 25, 2003

(30) Foreign Application Priority Data

Mar. 22, 2002 (KR) ..... 10-2002-0015715

(51) Int. Cl.[7] ..... B21D 26/02

(52) U.S. Cl. ..... 72/61; 72/58; 72/404; 72/455; 29/421.1

(58) Field of Search ..... 72/58, 61, 62, 72/404, 455, 456, 472; 29/421.1, 430; 10/214

(56) References Cited

U.S. PATENT DOCUMENTS 1,844,098 A * 2/1932 Lytle ..... 269/21
2,222,762 A * 11/1940 Debor et al. ..... 72/62
2,331,015 A * 10/1943 Dawes et al. ..... 100/208
2,869,177 A * 1/1959 Jurgeleit ..... 72/456
6,006,568 A * 12/1999 Bihrer ..... 72/60
6,170,309 B1 * 1/2001 Marando ..... 72/61
6,386,009 B1 * 5/2002 Ni et al. ..... 72/61
6,613,164 B2 * 9/2003 Dykstra et al. ..... 72/62

* cited by examiner

*Primary Examiner*—David B. Jones
(74) *Attorney, Agent, or Firm*—Scully, Scott, Murphy & Presser

(57) ABSTRACT

An apparatus of superplastic forming for massive production is able to install a plurality of forming sheets and plates in one apparatus using dies of multi-layer structure and to form the sheets and plates with compressed gas, and therefore, a plurality of products can be fabricated rapidly and massively with a cheap facility investment. If preforms are used instead of flat blank sheets, the productivity can be improved greatly and the products of uniform thickness can be formed massively.

14 Claims, 9 Drawing Sheets

APPARATUS FOR SUPERPLASTIC FORMING

BACKGROUND OF THE INVENTION

1. Field of the Invention

The present invention relates to an apparatus for superplastic forming for forming a metal sheet or plate by compressing it with a gas.

2. Description of the Background Art

Superplastic forming is a technology of forming a metallic sheet or plate mounted on a die in a sealed chamber by compressing it with a gas from opposite side of the die using a property that a material of fine grain structure has very high ductility of hundreds~thousands % and low flow stress in a range of strain rate and high temperatures. Therefore, the forming method has advantages such that deep and complex shapes, which can not be formed by another forming methods such as a conventional deep drawing method, can be formed in one piece in a single press cycle.

However, the conventional superplastic forming method has a problem to fabricate massively a lot of products with one press, because the forming process requires heating of dies and sheet metals to a uniform high temperature, and is conducted at low speed with one or a few dies arranged on a single bed of a same floor. Therefore, in order to produce massively in the conventional method, a lot of forming presses should be made, or a big size of the bed should be used so that a lot of dies can be arranged simultaneously on a single apparatus.

However, the former conventional method has a disadvantage that the cost of the product increases since fabrication of a lot of forming apparatuses needs high cost. Also, the latter conventional method has disadvantages such that an expensive high-power press should be used since the force of the press to keep chambers or dies closed during forming increases in proportion to the total area of the horizontal plane of dies on the bed where forming pressure is applied (plane area of the bed), and thereby, the fabrication cost is also increased.

Furthermore, since the superplastic forming is performed at a low speed, cycle times for forming range from 10 to 100 minutes or more according to depth of component and detailed design. Therefore, the superplastic forming can not be applied to the fields requiring mass production such as car industry, and has been used in the fields of small quantity batch production such as aerospace industry, railway vehicle, sports car, medical instrument, military electric device and architecture panels so far. Moreover, as the superplastic forming is done mostly under a plane strain or biaxial tension state having low forming limit, there is a limit in the depth which can be formed. Thus, an expensive material having extra high ductility should be used in order to make a product of high aspect ratio (ratio of a depth to a width of the product). Also, thickness distribution is not uniform after the superplastic forming, and therefore, complicated methods and processes should be used in case that uniform thickness is required.

SUMMARY OF THE INVENTION

An object of the present invention is to provide a superplastic forming apparatus of a new structure by which mass production can be made without increasing forming apparatuses or using a high-power press with a big size bed.

Another object of the present invention is to provide a forming method by which a product having a large aspect ratio and uniform thickness can be formed with high productivity using an ordinary superplastic material, and without using a special apparatus and material of high price.

To achieve the objects of the present invention, as embodied and broadly described herein, the present invention arranges chambers and dies in up-and-down direction of a press instead of arranging them horizontally on a wide bed in a high-power press or a large number of presses, in order to produce massively the products without using a high-power press having a large size bed or without increasing the number of the presses.

Also, to achieve another object of the present invention mentioned above, a superplastic forming method is combined with a deep drawing process, where a simple shape of high aspect ratio is made in advance by a deep drawing method, and used as a preform for subsequent superplastic forming to complete a complex is shape. By this method, a complex shape having high aspect ratio can be made with some additional advantages of a uniform thickness distribution and a short total forming time in a minute or less, since deep drawing leads to more uniform thickness distribution than superplastic forming, and it takes only a few seconds to make the preform by deep drawing, and tens of seconds to complete the remaining complex shape by superplastic forming. Otherwise, it takes tens of minutes or more to form a complex shape by the conventional superplastic forming method.

In detail, to achieve the objects of the present invention, there is provided an apparatus for superplastic forming, which allows a large number of complex parts to be formed from sheets in a press by forcing heated sheet into dies arranged on several layers with compressed gas or air. The apparatus consists of several sets of vertically layered dies having one or more gas injection holes and one or more gas discharging holes; a heating unit for providing dies with heat; a sets of sealed chambers wherein dies are installed in a pressurized state during forming; and a press for compressing dies or chambers. According to circumstances, the sealed chamber may not be used, and then, the die itself may have the functions of the sealed structure.

The gas injection hole may be formed on the upper metallic pattern, on the lower metallic pattern, or may be formed on intermediate portion of the upper and lower metallic patterns.

Two sheets of forming plates can be inserted into the respective dies in each layer, and in this case, it is desirable that the gas injection hole is formed so that the gas can be injected between the two plates.

The apparatus of the present invention may further comprises an auxiliary device between the upper and the lower dies. In this case, the gas injection hole may be formed in the auxiliary device, and a pair of forming sheets to be formed simultaneously is inserted into the upper and lower parts of the auxiliary device.

In another embodiment of the present invention, chambers and dies are installed on plural floors or layers, and the respective chambers or dies includes one or more guide rods which move in the guide hole of the opposite chambers or dies. The respective chambers or dies are guided by the guide rod, and thereby, can be separated each other or coupled together without misfit or dislocation.

Also, another embodiment of the present invention further comprises a supporting board adjacent to both sides of the sealed structure in vertical direction. In this case, the chamber on each layer includes one ore more protruded portions on outer surface thereof, and one or more recesses indented toward inside of the supporting board surface are formed on the positions corresponding to the protruded portion. The protruded parts and indented recesses which are matched together as a pair are used to separate or couple the adjacent layers one by one or simultaneously.

For successive separation or coupling, the respective recesses have different lengths from those of each other, and it is desirable that the length of lower recess is longer than that of an upper guide recess in order to lift the upper layer first and then the lower layer next. On the other hand, the recesses have the same length for simultaneous separation or coupling.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
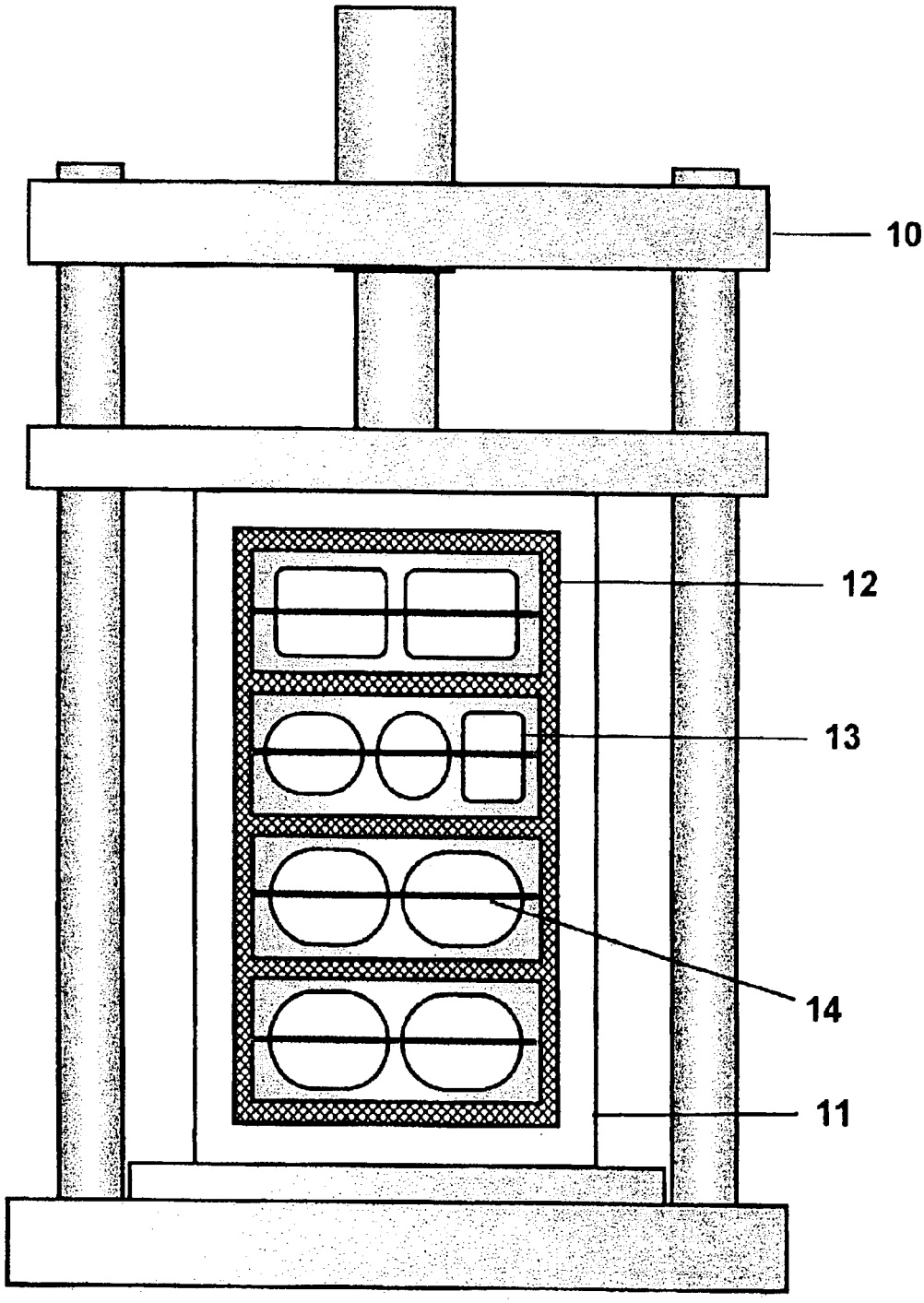
FIG. 1 is a cross-sectional view showing an apparatus for superplastic forming according to the present invention.

FIG. 1 is a cross-sectional view showing a structure of an apparatus according to the present invention, as shown therein, a plurality of dies 13 are layered vertically in a press 10, and heating units 12 and chambers 11 surround on outer part of the dies.

The dies are layered in a plurality of floors in up-and-down direction instead of arranging dies widely in a single floor in a conventional apparatus, and forming sheets 14 are installed in the respective dies to produce a lot of products at one time.

That is, in the conventional art, a lot of presses should be used or a high pressure press of high price having a bed of larger area on a horizontal plane should be used in order to produce massively, however, in the present invention, the number of layers on which the dies are arranged is increased, and therefore, mass production can be made without using a plurality of presses or using the high pressure press. Accordingly, the amount of investment for the press facility can be reduced, and thereby, fabrication cost can also be reduced. It is because that the force required by the press is not related to the number of layers, but related to the planar area of the dies arranged horizontally on a floor. In case of the dies layered in up-and-down direction, the force bulging dies to up and down directions by gas pressure is equilibrated by the force generated in the upper and lower dies, and therefore the multi-layered press needs nearly the same power or force as a single layered press requires.

Figure 2:
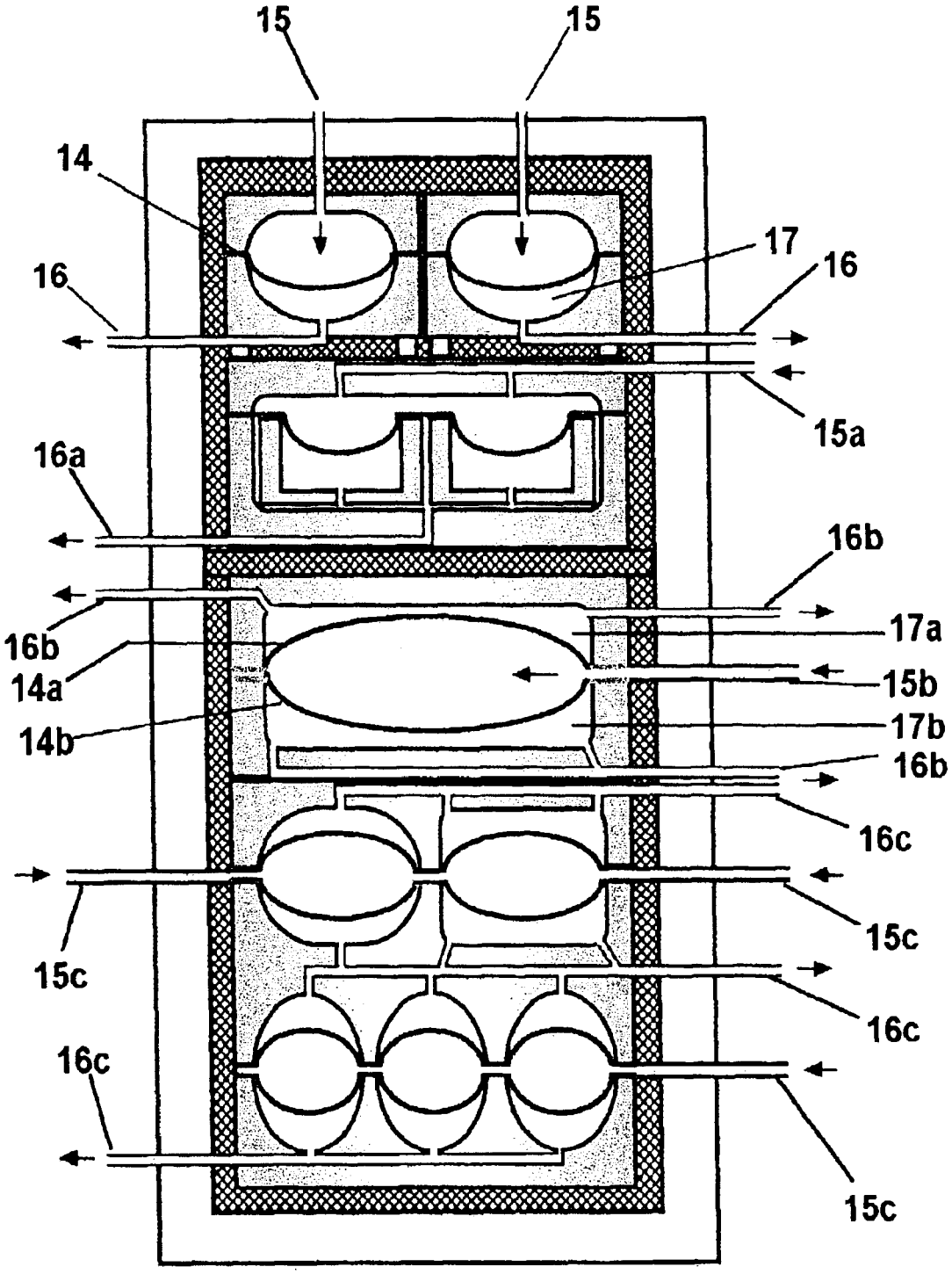
FIG. 2 is a cross-sectional view showing dies according to an embodiment of the present invention.

FIG. 2 is a cross-sectional view showing the structure of the die 13 in detail, as shown therein, the dies can be layered in a various forms to make the multi-layer structure. The respective die comprises a gas injection hole, a gas discharging hole and a forming space. The respective die is divided into an upper die and a lower die, however, these are integrated in Figure. The arrow on the Figure represents flow of the gas injected into the die and the gas discharged out of the die.

The gas injection hole 15 is formed on upper part of the die or chamber, and the forming sheet 14 is expanded toward the forming space 17 in the die by the pressure of the supplied gas to be formed in desired shape. In Figures, the shapes of changing plate in the forming process is shown typically. The gas pushed out of the forming space when the forming plate is expanded by the injected gas is discharged through an outlet 16. The gas is induced into the two forming spaces from one gas injection hole 15*a* in the second die from the top, and the gas is discharged through one gas discharging hole 16*a*. As described above, inlet and outlet of the gas induced into the die can be changed in a variety of form.

Moreover, the gas can be compressed to the respective dies in the laminated body of multi-layer structure to produce a lot of products in a time.

In a center portion of the layered body shown in FIG. 2, two forming plates 14*a* and 14*b* are inserted into the die in order to improve the productivity by forming a pair of parts in a die set at the same time. When the gas pressure is compressed between the two plates through the gas injection hole 15*b*, the plates are expanded toward the two forming spaces 17*a* and 17*b* and transformed, and the gas in the forming spaces is discharged to outer side through the gas discharging hole 17*b*. Therefore, two products can be fabricated simultaneously in one forming cycle with one die set. When a lot of dies are installed, more products can be fabricated simultaneously.

In lower part of FIG. 2, a plurality of dies share the gas injection hole 15*c* and the gas discharging hole 16*c*. Therefore, the gas injection or the gas discharge can be controlled altogether.

As described above, according to the forming apparatus of the present invention, the dies can be layered and arranged in various configurations in one apparatus, and the injection and discharge of the gas can be changed in a variety of forms.

On the other hand, the press 10 pushes down the chamber so that the die is not open when the sheet is deformed by the gas pressure in the die. The force required to clamp the die is not related to the height of the die, but related to the plane area of the die. Therefore, if the dies are arranged widely side by side, the press of high power and high price is required, however, when the dies are piled up in up-and-down direction to be multi-layer structure, the above press of high price is not required.

Figure 3:
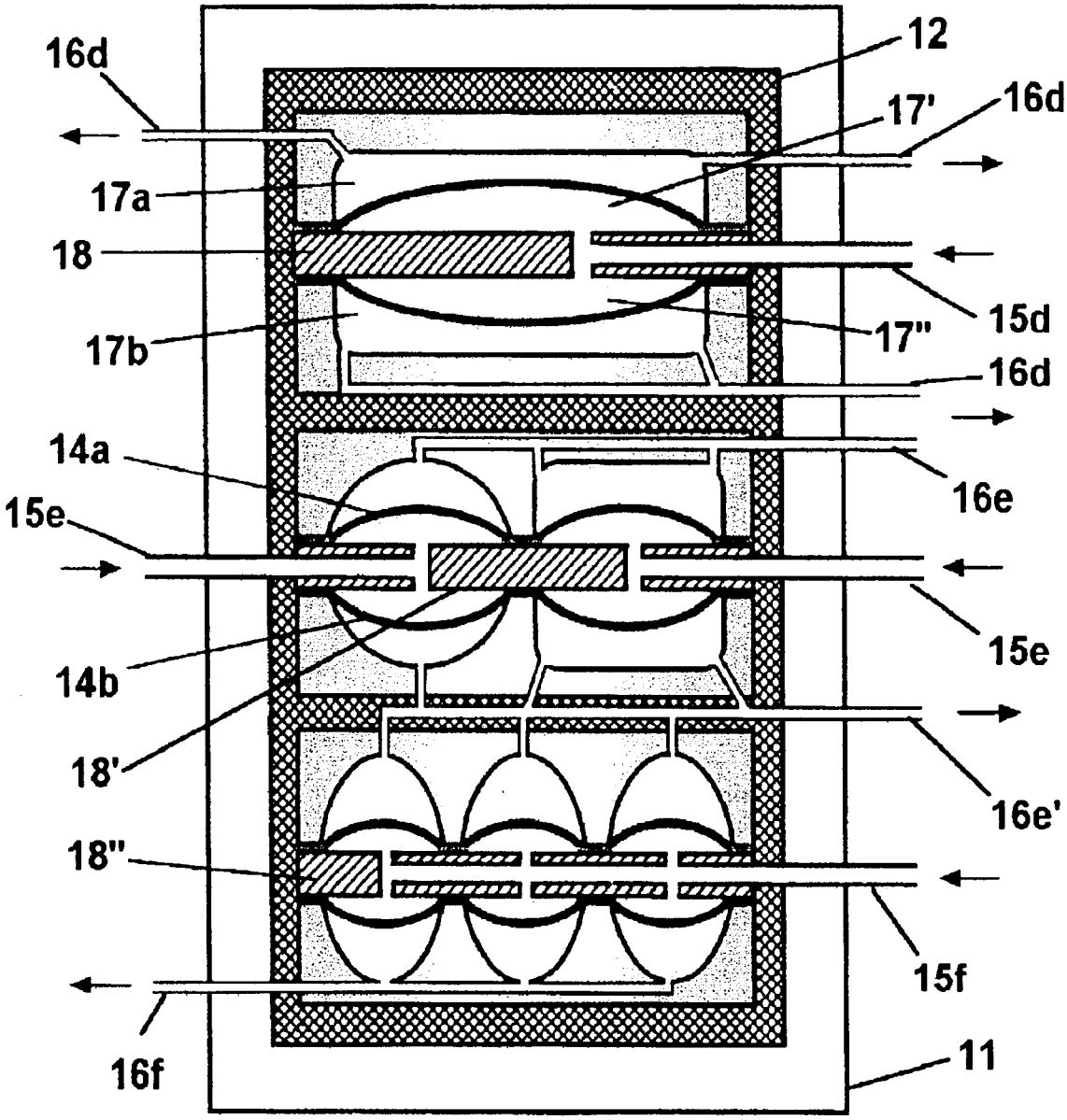
FIG. 3 is a cross-sectional view showing dies according to another embodiment of the present invention.

FIG. 3 shows another embodiment of the present invention, installing and sealing the forming plates are made easily when two forming sheets are inserted into the die and the materials are formed simultaneously using both sides of the die set. An auxiliary device 18 is installed between the upper and lower dies, and the forming sheets are inserted into upper and lower part of the auxiliary device 18. A gas line connected from the gas injection hole is formed in the auxiliary device.

The gas supplied into the gas injection hole 15*d* is injected into spaces 17' and 17" in the die through the gas line in the auxiliary device, and the two plates on upper and lower parts of the auxiliary device are expanded toward the forming spaces 17*a* and 17*b* to be formed. In addition, the mass producing effect can be improved when the multi-layer structure is made above dies.

In the die on center part of FIG. 3, the gas injection holes 15*e* are formed on both sides of the die and the gas discharging hole 16*e* and 16' are formed on upper and lower parts of the die. Also, the lower die shown in FIG. 3 includes a gas injection hole 15*f*, and the gas discharging holes 16*e*' and 16*f* formed on upper and lower parts thereof, and one of the gas discharging holes are shared by the center die and the lower die.

Figure 4:
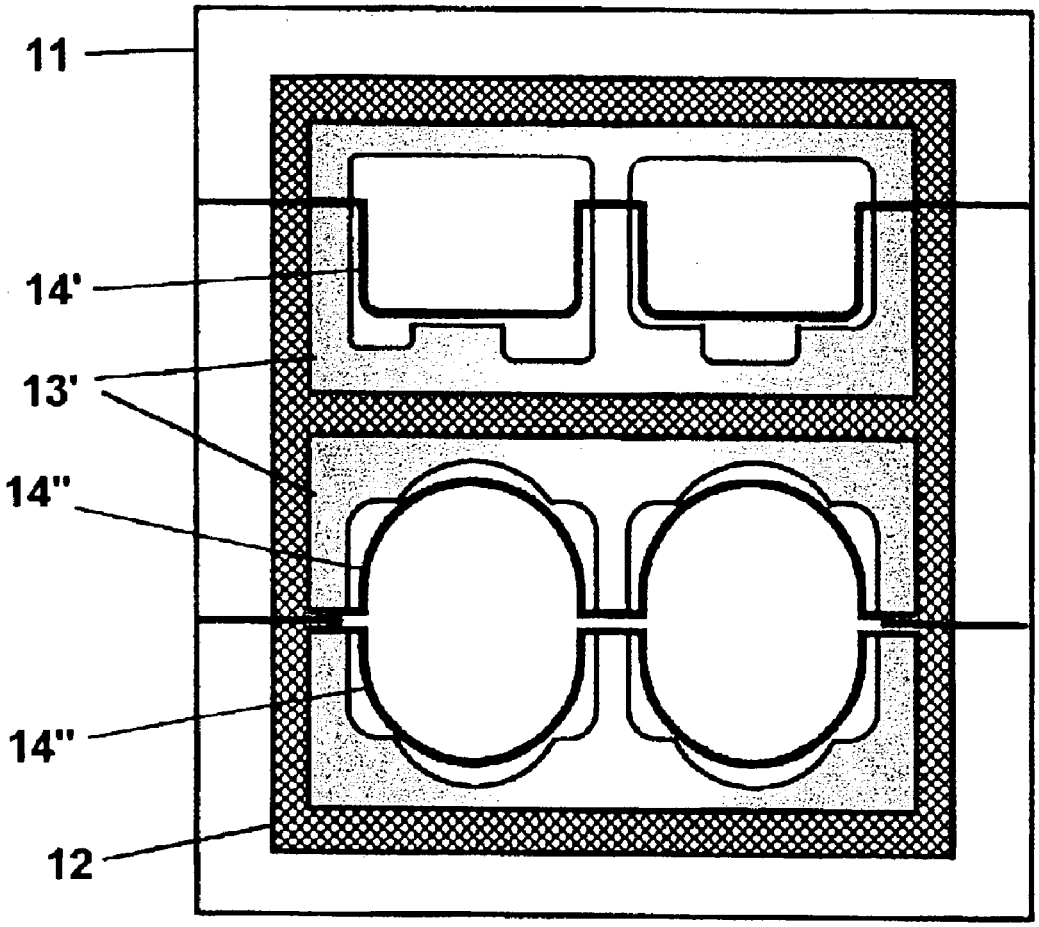
FIG. 4 is a cross-sectional view showing dies on which preforms are installed.

FIG. 4 shows a multi-layerved die structure in which preforms 14' and 14" which are formed to have predetermined shapes are installed on the die instead of flat sheet blanks as the forming material. When preforms are used, the forming time can reduce to a minute or less, resulting in additional improvement of productivity as compared with the case using flat sheet blanks.

Although It is difficult to fabricate complex shapes using the deep drawing method, the forming speed is so rapid that the product can be fabricated in a few seconds and deep shapes of a high aspect ratio can be obtained. Therefore, a preform is fabricated in advance in the deep drawing method, and then, the preform is installed on the die and deformed to a final complex shape by the gas pressure in the superplastic forming process as shown in FIG. 4, and then, a deep and complex shape can be formed in a short period.

That is, when the superplastic forming method is combined with the deep drawing method, the product having both a high aspect ratio of a deep shape and a complex shape can be produced massively in the short period. Furthermore, as compared with superplastic forming exhibiting high reduction in thickness in the central part of the sheet, the preform fabricated by the deep drawing method has more uniform thickness distribution, and so, the final product of uniform thickness can be obtained by the combined method of deep drawing and superplastic forming.

In the mass production, processes of inserting plate into the die and of pulling out the formed product rapidly are very important.

Figure 5:
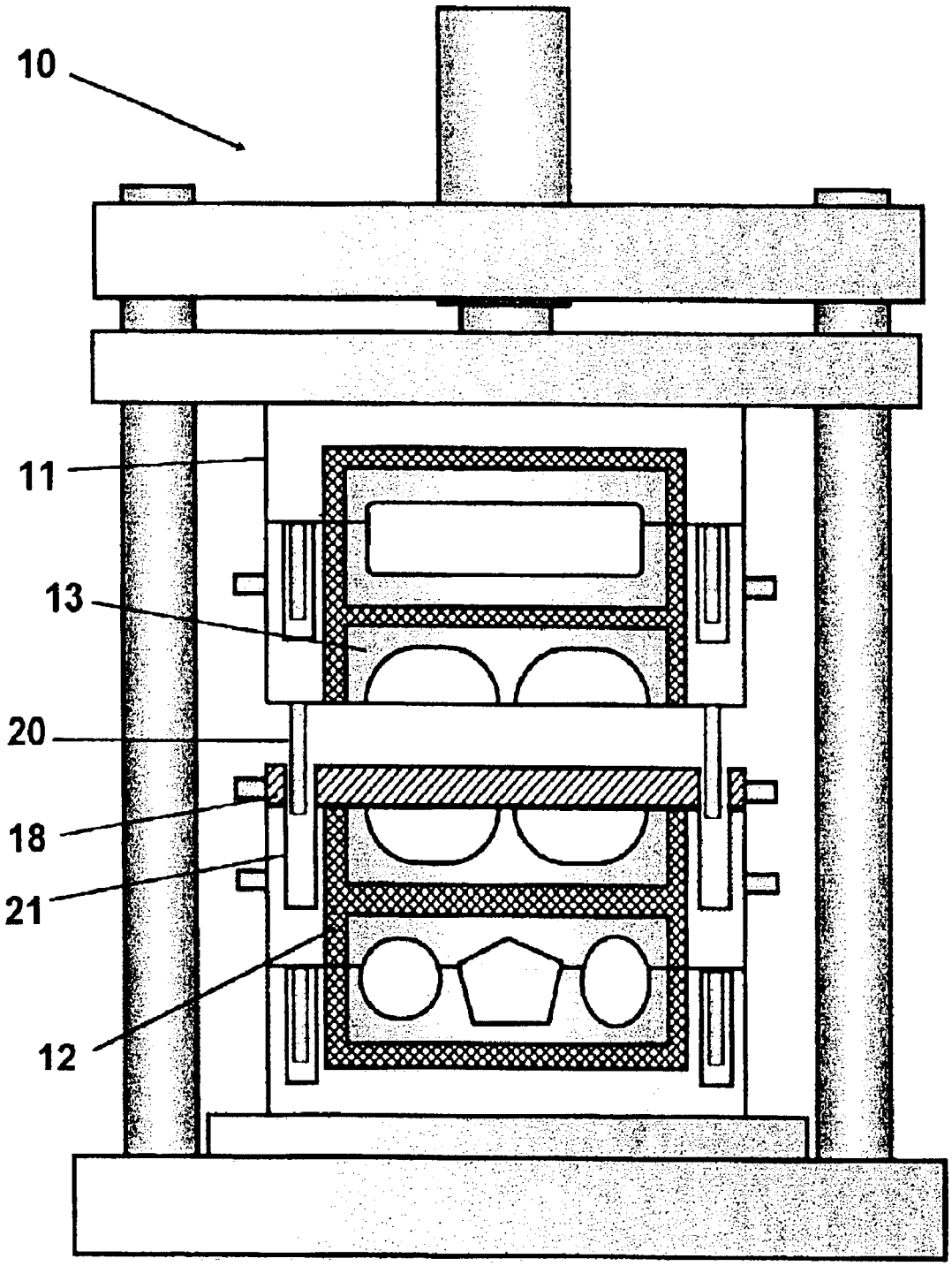
FIG. 5 is a cross-sectional view showing an example of separating dies as another embodiment of the present invention.

FIG. 5 is a cross-sectional view showing an embodiment of inserting the forming plate into the die or pulling out rapidly the formed product in the forming apparatus according to the present invention.

The chamber 11 and the heating unit 12 are arranged to be the plural layers, and one or more of guide rod 20 protrusively formed in vertical direction and a guide hole 21 formed indentedly are formed on end portions of the respective chambers.

In order to insert the plate or pull out the formed product by separating one of the layered dies, a desired die is lifted by hanging a loop on protruded portions which are protrusively formed on both sides of the chamber in horizontal direction or by inserting the rod into a hole indented in the horizontal direction. That is, the above method is useful for separating the desired die selectively one by one, and FIG. 5 shows an example that the die is separated. Subsequently or at the same time, the dies on other layers can be lifted in order to insert the material and the formed product. The guide rod 20 and the guide hole 21 are to make the dies move along a desired direction without dislocation when the die is separated.

Figure 6A:
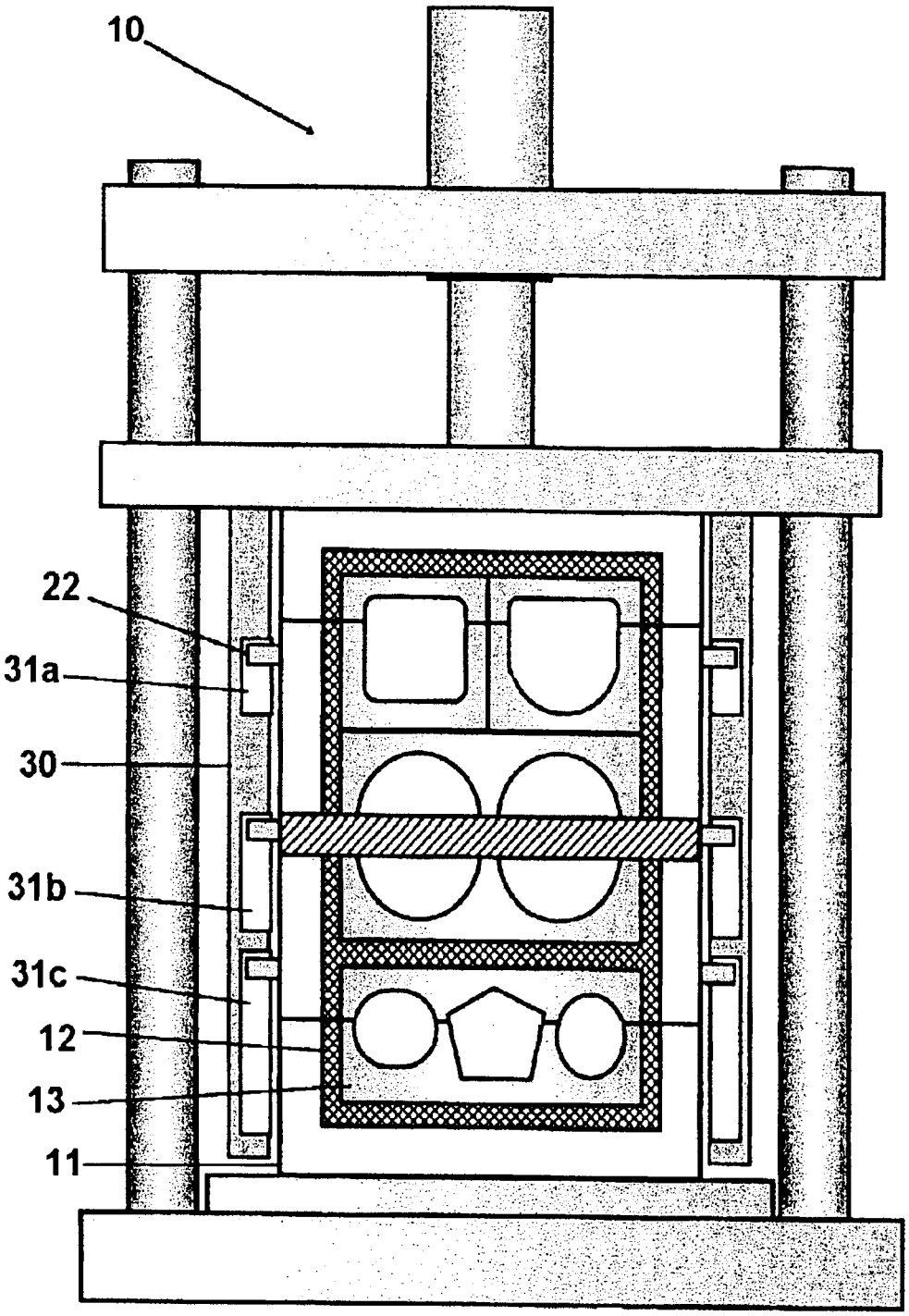
FIG. 6*a* is a cross-sectional view showing a still another embodiment of the present invention.

FIG. 6*a* shows an example that the forming material or the formed product is inserted or pulled out sequentially or simultaneously. Supporting boards 30 in vertical direction is installed to be adjacent to both sides of the chamber 11. The chamber 11 and the heating unit 12 are arranged to be a plurality of layers, the respective chamber includes the protruded parts 22 formed on outer side thereof in horizontal direction, and a plurality of guide recesses 31*a*, 31*b* and 31*c* indented toward inside of the supporting board 30 are formed on the positions which are corresponded to the protruded portions.

The respective guide recesses have different lengths from those of each other, and the length of lower guide recess is longer than that of the upper guide recess. The respective layers with chamber and the heating unit are lifted sequentially when the protruded part 22 of each layer is hooked one by one by the guide recesses 31*a*, 31*b* and 31*c* during moving up of the supporting board 30, and thereby, all of the layers can be separated each other. On the other hand, the respective layers are coupled sequentially when the protruded part 22 of each layer is unlocked one by one by the guide recesses 31*a*, 31*b* and 31*c* during moving down of the supporting board 30, and thereby, all of the layers can be combined again.

Figure 6B:
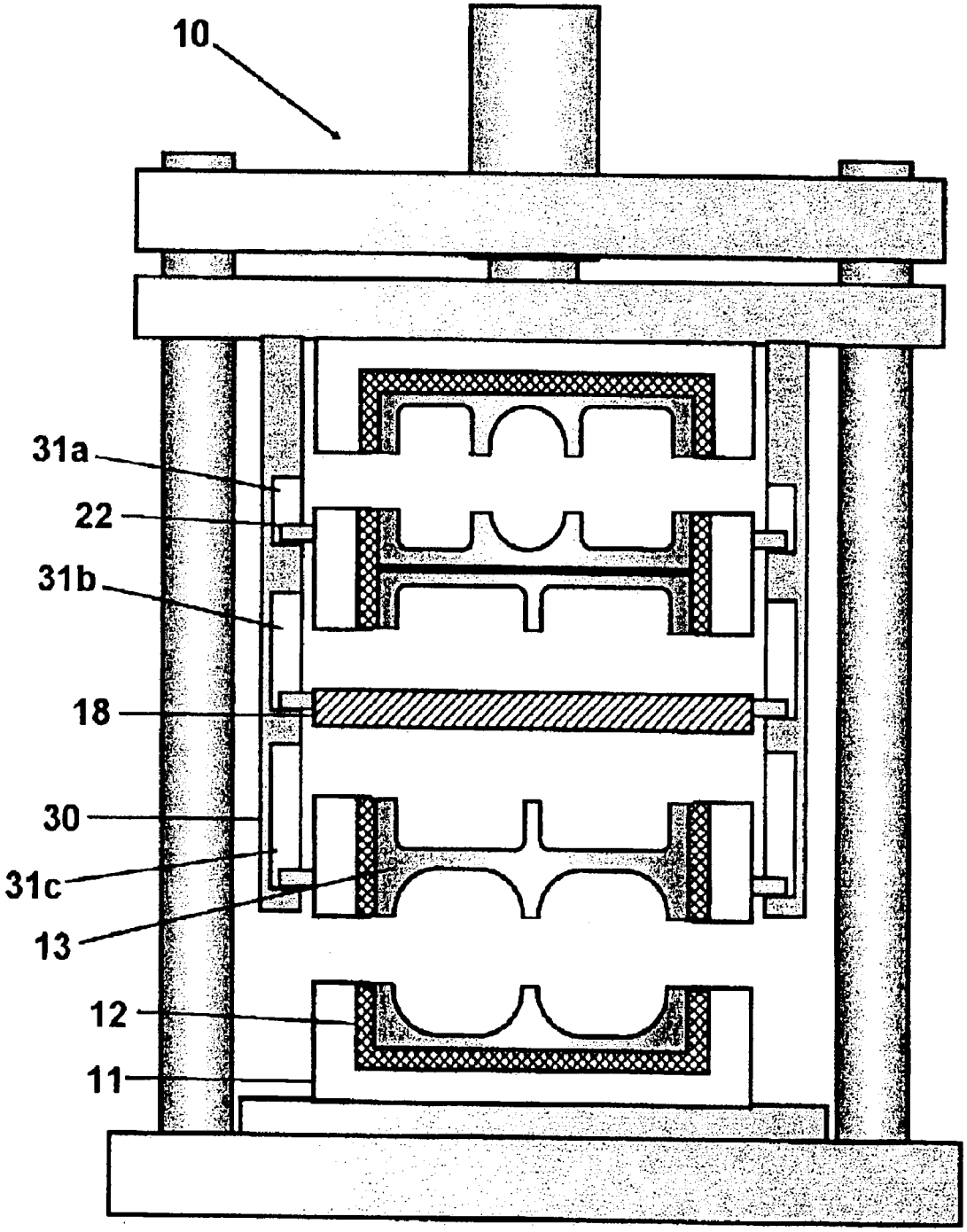
FIG. 6*b* is a cross-sectional view showing an example that dies are separated in the apparatus shown in FIG. 6*a;*

FIG. 6*b* shows a status that the layers of the die system are lifted all together using the supporting board in the apparatus shown in FIG. 6*a*. When the supporting board 30 is moved upward, the dies are lifted sequentially from the top, and when the supporting board 30 is moved downward, the dies are coupled sequentially from the bottom.

Figure 6C:
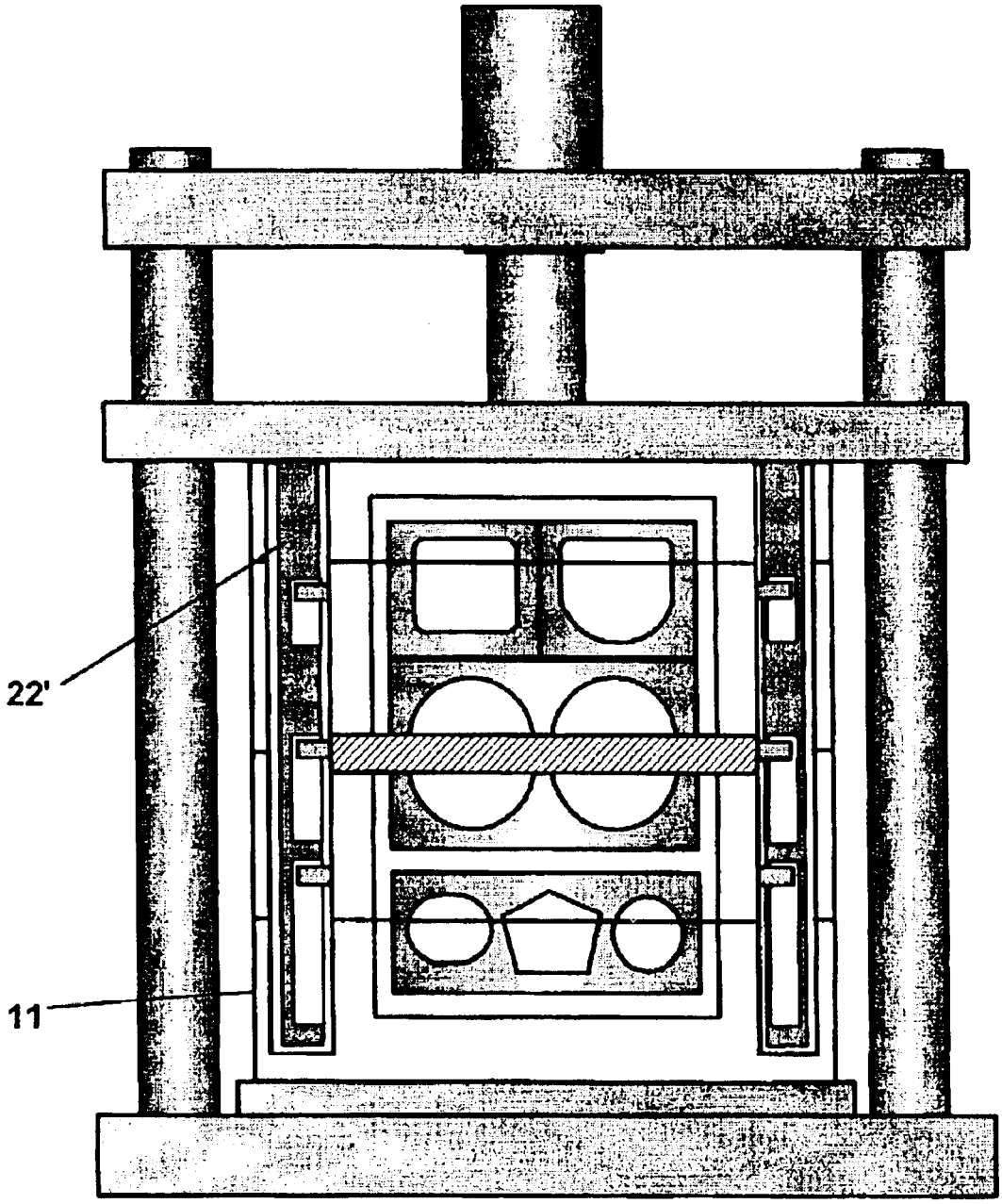
FIG. 6*c* is a cross-sectional view showing a still another embodiment of the present invention.

The above method leads to much faster processes than that of FIG. 5 using other devices to lift up respective layers, and therefore, the productivity can be improved greatly. This is one of the most important factor in the multi-layer forming apparatus of the present invention, and FIGS. 5, 6*a* and 6*b* suggest some technical solutions. The above embodiments show some of the various methods, and the methods are not limited within the suggested Figures if these have same functions. That is, shapes or the number of the supporting board 30 is not limited if the supporting board is able to lift and pull down the dies simultaneously or sequentially. As an example, a protrusion may be formed on the supporting board, and a recess may be formed on the surface of the chamber. Also, as shown in FIG. 6*c*, if recesses are formed on both ends of the chamber 11 and the supporting board having protrusion 22' is located in the recess to be moved in up-and-down direction in the recess, the function of guide rod 20 shown in FIG. 5 can be replaced by the supporting board 22' in FIG. 6*c*, and the dies can be lifted and pulled down one by one or simultaneously.

Figure 7:
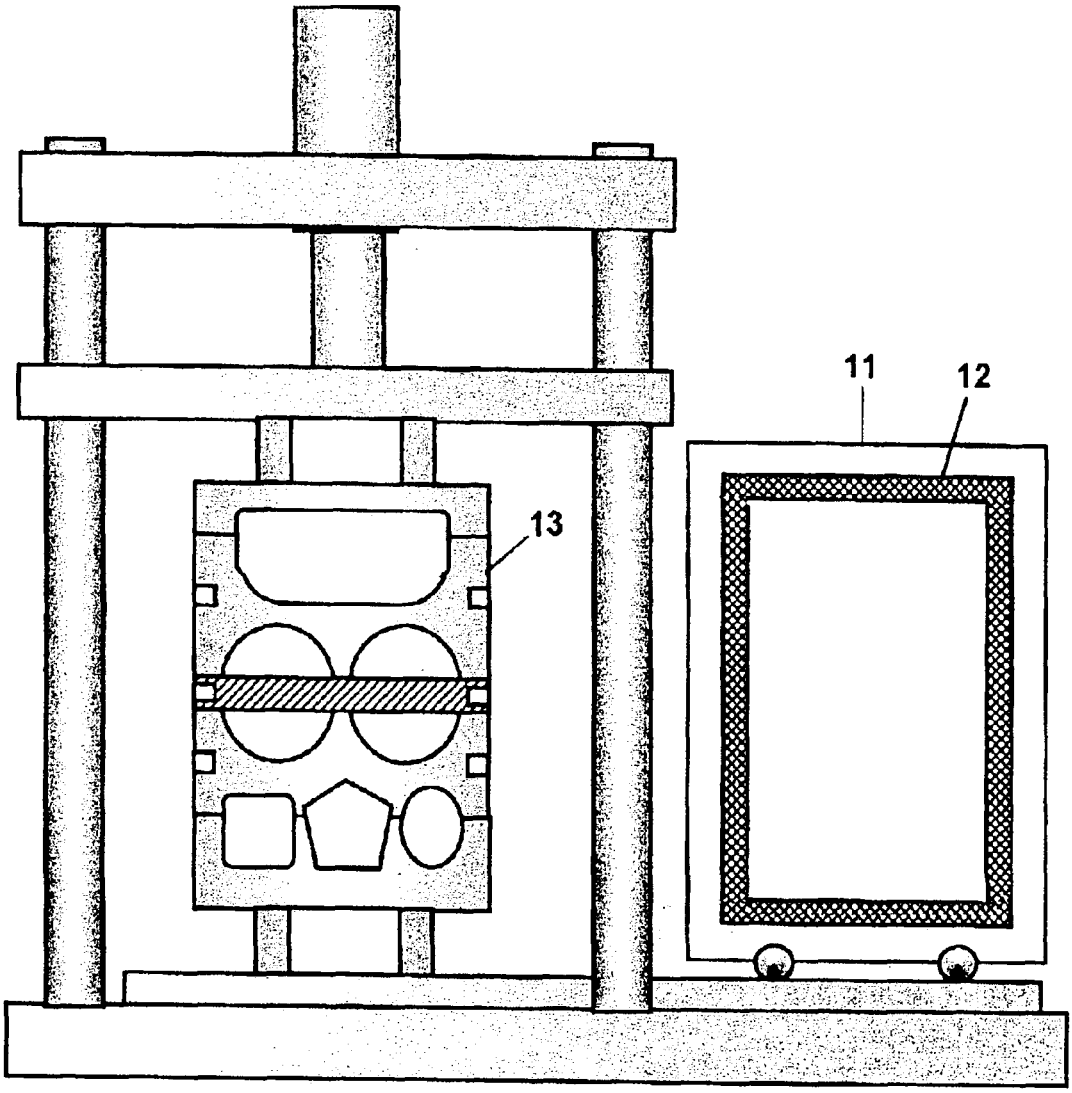
FIG. 7 is a cross-sectional view showing dies and a heating unit separated from each other.

FIG. 7 shows a status that the die 13 and the chamber 11 and the heating unit 12 are separated from each other. In a state that all of the dies 13 and the heating units 12 are separated from each other, the material for forming is installed at the same time, and the formed products are taken out of the dies simultaneously. For forming, the dies 13 and the heating units 12 are coupled again. Also, the forming material can be installed and the formed product can be pulled out by separating the die in the multi-layer from the heating unit sequentially one by one. The mass production can also be made by these methods which separate completely the whole heating units from the die and chamber system.

On the other hand, the respective forming apparatus does not necessarily have to be stand vertically, and may be installed as laying down the apparatus transversely in case that it is difficult to install the apparatus vertically due to the height of a space where the apparatus will be installed.

As described above, according to the present invention, the superplastic forming apparatus is fabricated in the multi-layer structure, the material is formed rapidly and effectively, and then, the formed product is pulled out, and thereby, a plurality of products can be fabricated massively in a short period. In addition, the productivity can be improved and the fabrication cost can be reduced greatly. Moreover, since the capacity of the press required by the present invention is not high despite of the mass production, the facility investment can be reduced greatly when comparing to the conventional art in which the mass production can be made only when a plurality of presses are used or the high-power press of high price is used. Also, when preforms instead of flat sheets are used, the forming time can be reduced greatly and the products of uniform thickness can be formed massively. Besides, the mass production can be made without using a special material of high price which can be formed rapidly, and therefore, the fabrication cost can be reduced further.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for superplastic forming, which forms at least one sheet or plate into a predetermined shape by directing a compressed gas onto the sheet or plate while said at least one sheet or plate is located in a die, comprising:

a layered body of at least two said dies which are arranged on several beds, and said dies having at least one gas injection hole and at least one gas discharging hole;

a heating unit extending around the layered body for providing each said die with external heat;

a chamber formed on an outer surface of the heating unit for sealing the at least two said dies except the at least one gas injection hole and the at least one gas discharging hole; and a press for compressing the dies into a closed condition during forming, wherein each respective one of said dies in the layered body includes an upper cavity and a lower cavity.

2. The apparatus of claim 1, wherein each respective said die has inserted therein a preform configured in advance for being formed into a predetermined shape upon insertion of the respective dies in the layered body.

3. The apparatus of claim 1, wherein two said forming sheets or plates are inserted into the respective dies in the layered body, and the at least one gas injection hole is formed to inject the compressed gas between the two plates.

4. The apparatus of claim 3, wherein said at least two dies comprise an upper and a lower die, further comprising an auxiliary die arrayed between the upper die and the lower die.

5. The apparatus of claim 4, wherein said auxiliary die includes upper and lower parts, said sheets or plates being formed are inserted into respectively said upper and lower parts of the auxiliary die.

6. The apparatus of claim 1, wherein the chamber and the heating unit are arranged in a plurality of layers, each respective layer including at least one protruding portion on an outer surface of said layer extending in a horizontal direction.

7. The apparatus of claim 6, wherein each of the respective layers include at least one protruding guide rod and a guide hole, the guide rod being selectively insertable into the guide hole or separated from the guide hole so that the respective layers having chambers and heating units are guided by the guide rod, and thereby, separated from each other or coupled together.

8. The apparatus of claim 1, further comprising supporting boards arranged adjacent to opposite sides of the chamber.

9. The apparatus of claim 8, wherein the chamber and the heating unit are arranged in a plurality of layers, each respective said layer including at least one protruding portion on an outer surface of said layer extending in a horizontal direction, and each said supporting board includes at least one guide recess indented toward an inside of the supporting board surface at positions which correspond to the protruding portions.

10. The apparatus of claim 9, wherein the respective guide recesses have different lengths from each other, and the length of a respectively lower said guide recess is longer than that of a respective said upper guide recess.

11. The apparatus of claim 9, wherein the respective layers of the chambers and the heating units are guided by the guide recesses, so as to be mutually separated or coupled sequentially.

12. The apparatus of claim 8, wherein the chamber and the heating unit are arranged in a plurality of layers, each said supporting board including at least one protruding portion formed on an outer surface thereof, and the respective chamber includes at least one guide recess indented toward an inside of the surface of the chamber at positions corresponding to the protruding portions.

13. The apparatus of claim 1, further comprising supporting boards located inside of holes, which are formed at both opposite sides of the chamber, wherein the chamber and the heating unit are arranged in a plurality of layers, each said layer including at least one protruding portion on the holes extending in horizontal direction, and each said supporting board includes at least one guide recess indented toward an inside of the supporting board surface at positions corresponding to the protruding portions.

14. The apparatus of claim 1, wherein the heating unit is separable from the layered body.

* * * * *